US007610970B2

(12) United States Patent
Sihler et al.

(10) Patent No.: US 7,610,970 B2
(45) Date of Patent: Nov. 3, 2009

(54) APPARATUS FOR ELIMINATING NET DRILL BIT TORQUE AND CONTROLLING DRILL BIT WALK

(75) Inventors: Joachim Sihler, Cheltenham (GB); Michael John Shepherd, Stroud (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 349 days.

(21) Appl. No.: 11/567,756

(22) Filed: Dec. 7, 2006

(65) Prior Publication Data

US 2008/0135292 A1 Jun. 12, 2008

(51) Int. Cl.
*E21B 44/00* (2006.01)

(52) U.S. Cl. ..... 175/61; 175/24; 175/27; 175/73

(58) Field of Classification Search ..... 175/24, 175/27, 61, 73
See application file for complete search history.

(56) References Cited

U.S. PATENT DOCUMENTS

| | | | | |
|---|---|---|---|---|
| 3,722,610 | A * | 3/1973 | Hornsten | 175/386 |
| 5,845,721 | A | 12/1998 | Southard | |
| 6,092,610 | A * | 7/2000 | Kosmala et al. | 175/61 |
| 6,325,163 | B2 * | 12/2001 | Tibbitts | 175/57 |
| 6,378,626 | B1 * | 4/2002 | Wallace | 175/19 |
| 7,093,673 | B2 | 8/2006 | Stokka | |
| 2001/0045300 | A1 * | 11/2001 | Fincher et al. | 175/26 |
| 2004/0011558 | A1 | 1/2004 | Stokka | |
| 2004/0262043 | A1 * | 12/2004 | Schuaf | 175/57 |
| 2006/0042835 | A1 * | 3/2006 | Guerrero et al. | 175/61 |

FOREIGN PATENT DOCUMENTS

WO WO 2008/004999 A1 1/2008

OTHER PUBLICATIONS

Southard, "New Assembly Drills without Reactive Torque", SPE/IADC 105000, 2007.
Eskin et al., "Former-USSR R&D on Novel Drilling Techniques", Chapter 1.8 Large-Hole Stepwise Drilling Technique by Dr. V. Zaretsky, pp. 1.8-1-1.8-9. Copyright 1995 Maurer Engeineering Inc.

* cited by examiner

*Primary Examiner*—Jennifer H Gay
*Assistant Examiner*—Nicole A Coy
(74) *Attorney, Agent, or Firm*—Brigid Laffey; James McAleenan; Jody Lynn DeStefanis

(57) ABSTRACT

A drilling apparatus controls or eliminates reaction torque from drill bits thereby preventing loss of penetration due to undesired rotation of the drilling apparatus or controls drilling direction by intentionally manipulating reaction torque thereby inducing desired drill bit walk. The drilling apparatus has a concentrically divided drill bit in which an inner drill bit rotates simultaneously in the opposite direction from an outer drill bit. The inner drill bit can be moved axially forward from or back toward the outer drill bit. Forces produced by the inner and outer drill bits are controlled to eliminate or adjust reaction torque.

20 Claims, 13 Drawing Sheets

APPARATUS FOR ELIMINATING NET DRILL BIT TORQUE AND CONTROLLING DRILL BIT WALK

TECHNICAL FIELD

The present invention relates generally to oilfield drilling, and more particularly, to autonomous drilling devices and remotely controlled drilling robots used to drill boreholes.

BACKGROUND OF THE INVENTION

In oilfield operations, drilling into rock requires relatively large power levels and forces that are usually provided at the drilling rig by applying a torque and an axial force through a drill string to a drill bit. The lower portion of the drill string in a vertical well includes (from the bottom up) the drill bit, bit sub, stabilizers, drill collars, heavy-weight drill pipe, jarring devices and crossovers for various thread forms. The bottom hole assembly, hereinafter referred to as the BHA, provides force, the measure of which is referred to as "weight-on-bit", to break the rock and provide the driller with directional control of the well. In conventional drilling, the BHA is lowered into the wellbore using jointed drill pipes or coiled tubing. Often the BHA includes a mud motor, directional drilling and measuring equipment, measurements-while-drilling tools, logging-while-drilling tools and other specialized devices. A simple BHA consisting of a drill bit, various crossovers, and drill collars is relatively inexpensive, costing a few hundred thousand US dollars, while a complex BHA costs ten times or more than that amount.

The drill bit section of the BHA is used to crush or cut rock. A dull bit may result in failure to progress and must be replaced. Most drill bits work by scraping or crushing the rock, or both, usually as part of a continuous circular motion in a process known as rotary drilling. During rotary drilling cuttings are removed by drilling fluids circulated through the drill bit and up the wellbore to the surface.

The use of coiled tubing with downhole mud motors to turn the drill bit to deepen a wellbore is another form of drilling, one which proceeds quickly compared to using a jointed pipe drilling rig. By using coiled tubing, the connection time required with rotary drilling is eliminated. Coiled tube drilling is economical in several applications, such as drilling narrow wells, working in areas where a small rig footprint is essential, or when reentering wells for work-over operations.

Many drilling operations require direction control so as to position the well along a particular trajectory into a formation. Direction control, also referred to as "directional drilling," is accomplished using special BHA configurations, instruments to measure the path of the wellbore in three-dimensional space, data links to communicate measurements taken downhole to the surface, mud motors, and special BHA components and drill bits. The directional driller can use drilling parameters such as weight-on-bit and rotary speed to deflect the bit away from the axis of the existing wellbore. Conversely, in some cases, such as drilling into steeply dipping formations or due to an unpredictable deviation in conventional drilling operations, directional-drilling techniques may be employed to ensure that the hole is drilled vertically.

Direction control is most commonly accomplished through the use of a bend near the bit in a downhole steerable mud motor. The bend points the bit in a direction different from the axis of the wellbore when the entire drill string is not rotating. By pumping mud through the mud motor, the bit rotates though the drill string itself does not, allowing the bit alone to drill in the direction to which it points. When a particular wellbore direction is achieved, the new direction may be maintained by then rotating the entire drill string, including the bent section, so that the drill bit does not drill in a direction away from the intended wellbore axis, but instead sweeps around, bringing its direction in line with the existing wellbore. As it is well known by those skilled in the art, a drill bit has a tendency to stray from its intended drilling direction, a phenomenon known as "drill bit walk". Drill bit walk results from the cutting action, gravity and rotation of the drill bit as well as irregularities of the formation being drilled. It is desirable to eliminate or at least minimize the drill bit walk to ensure that the drilling operation proceeds in the desired direction. While drill bit walk is generally undesirable, drill bit walk which is controlled could produce an intentional and favorable deviation from the established direction of drilling.

Most boreholes are nearly vertical and not particularly deep. In such wells, standard wireline cables are capable of carrying logging tools and other equipment to a desired depth. However, the scarcity of petroleum has resulted in the desire to explore formations which are more difficult to reach. Therefore, with ever increasing frequency, boreholes are extremely deep and have high inclination angles. For many years, drill pipe and coiled tubing have conveyed drilling bit and drilling equipment into the wellbore. Once at the required downhole location, the equipment is expected to perform complex tasks that often need to be monitored and controlled in real time at a surface rig site far from the wellbore.

It is desirable to have alternative conveyance technologies available in order to explore deeper and more difficult wells. One such technology may be autonomous drilling robots that are not connected to surface equipment using drill pipe, coiled tubing or other means.

If drilling robots are to be developed that use conventional rotational drilling techniques, the drilling robots must be able to support both drilling reaction torque and thrust force. If the drilling robots cannot counteract the reaction torque, the drilling robots would commence to rotate in the wellbore thereby reducing efficiency of the drilling operation. Designing a drilling robot that counters reaction torque is even more difficult for a well with a small borehole. A low rate of penetration of the drilling robot in the borehole would result in reduced torque on the drilling robot. However, at higher rates of penetration, e.g., using the same rotational velocity as employed in conventional drilling techniques, it can be expected that torque will be a problem for the robot.

A device for controlling torque while drilling a borehole is disclosed in U.S. Pat. No. 5,845,721 to Robert Charles Southard, whose invention includes a tubular drill string with a motor for generating a rotary force. The device further includes an inner drilling device adapted to the motor means and an outer drilling device concentrically arranged about the inner drilling device. Southard's device includes a planetary gear system adapted for imparting the rotation generated from the motor to the outer drilling device. A shaft extending from the motor is operatively connected to the inner drilling device, and the shaft has a plurality of shaft splines thereon formed to cooperate with the planetary gear system. Due to the particular configuration of the planetary gear system, the inner and outer drilling devices rotate in opposite directions. The inner and outer drill bits have a fixed gear relation resulting in a rotation of the inner and outer drill bits at a constant relative speed.

A drilling device is disclosed in US Patent Application Publication Number 2004/0011558 A1 to Sigmund Stokka, whose invention includes a method of introducing instruments or measuring equipment or tools into formation of earth's crust or other solid material by means of a drilling device, material being liberated by rotation of a drill bit, and the liberated material thereafter flowing, or being pumped, past or through the drilling device. Stokka's method includes absorbing the reaction torque produced by the drill bit's rotary moment of inertia by alternating the direction of rotation of the drill bit.

From the foregoing it will be apparent to those skilled in the art that there is a need for a remotely controlled drilling robot that can drill a borehole or a lateral deviation from an existing borehole in the oilfield and for such a drilling robot to eliminate or control the drilling reaction torque and thrust force applied to the attached drilling module. Furthermore, there is a need for an improved method to eliminate, reduce or manage the reaction torque from the drill bit to the robot. Furthermore, there is a need for an improved method for controlling drill bit walk that is caused by reaction torque from the drill bit either for the purpose of ensuring controlled straight-ahead drilling using mechanical geostationary reference or to steer the drilling operation in a new direction.

SUMMARY OF THE INVENTION

The present invention provides an improvement in the art of oilfield drilling operations in which drilling devices such as remotely controlled drilling robots deployed to drill a borehole and control reaction torque thereby preventing the undesirable rotation of the drilling equipment and resulting loss of penetration. The success or failure of the drilling robot may hinge on the ability to eliminate the reaction torque from the drilling module of the drilling robot. Furthermore, a drilling apparatus according to the invention controls reaction torque for the purpose of steering drilling operations to achieve desired borehole trajectories. Furthermore, in drilling applications that include coiled tubing—for example, applications using a bent sub for steering—the reaction torque from the drill bit may rotate the bent sub that is used for steering. The present invention may be used in such applications to eliminate or control the reaction torque to increase stability of directional drilling.

In one embodiment of the invention, a drilling apparatus controls drill bit torque during a drilling operation. Such an apparatus includes a thrust module providing axial thrust force, a rotary coupling connected to the thrust module and a drilling module, wherein the rotary coupling transmits the thrust force from the thrust module to the drilling module, and comprising a rotary encoder operable to determine a relative rotation angle between the thrust module and the drilling module. The drilling module is connected to the rotary coupling to receive thrust from the thrust module and to receive signals from the rotary encoder indicative of relative rotation angle between the drilling module and the thrust module. The relative angle of the drilling module with respect to the formation or the mechanical ground is determined with respect to any geostationary reference, for example, drilling units that use drilling and inclination package which includes both an accelerometer and magnetometer. The geostationary reference can be quasi-stationary in that it may drift while traversing the wellbore but remain relatively stationary locally.

Furthermore, the drilling module comprises a drill bit divided concentrically into an outer drill bit and an inner drill bit; the inner and outer drill bits are connected to a power unit operable to drive the inner and outer drill bits in opposite directions simultaneously. The inner and outer drill bits are rotated by their respective driver motors which allow adjusting the speed of the inner and outer drill bits independently. The drilling module may also contain a linear actuator operable to provide axial movement of the inner drill bit with respect to the outer drill bit in response to the signals received from a control module. The control module may provide communication with the surface drilling and processing apparatus and uses the angular rotation of drilling module with respect to the thrust module to adjust the torque associated with the drill bits by making adjustments to the relative RPM of the inner and outer drill bits or by making movements to the linear actuator.

In an alternative embodiment, a drilling apparatus controls drill bit walk during drilling of a borehole for the purpose of steering the drilling operation. Such a drilling apparatus is composed of a cylindrical drill bit divided concentrically into an inner drill bit and an outer drill bit, the inner drill bit positioned inside the outer drill bit, the inner drill bit being operable to be moved axially forward away from or back within the outer drill bit, and a power unit operable to independently control the inner and outer drill bits. Furthermore, in an alternative embodiment, the drilling apparatus may contain a surface drilling and processing apparatus monitoring torque produced by the outer drill bit, torque produced by the inner drill bit, and the weight-on-bit of the outer drill bit and the inner drill bit. A control module of the drilling apparatus is connected to the power unit and operable to receive from the drilling and processing apparatus a resultant vector computed from component vectors corresponding to forces registered by the inner drill bit and the outer drill bit, compare the resultant vector to a desired vector corresponding to a desired drilling direction, determine at least one adjustment to at least one component vector required to modify the resultant vector to achieve the desired vector, and adjusting drilling parameters corresponding to the force corresponding to the adjusted at least one component vector thereby controlling the drilling direction of the apparatus.

Other aspects and advantages of the present invention will become apparent from the following detailed description, taken in conjunction with the accompanying drawings, illustrating, by way of example, the principles of the invention.

DETAILED DESCRIPTION OF THE INVENTION

Figure 1:
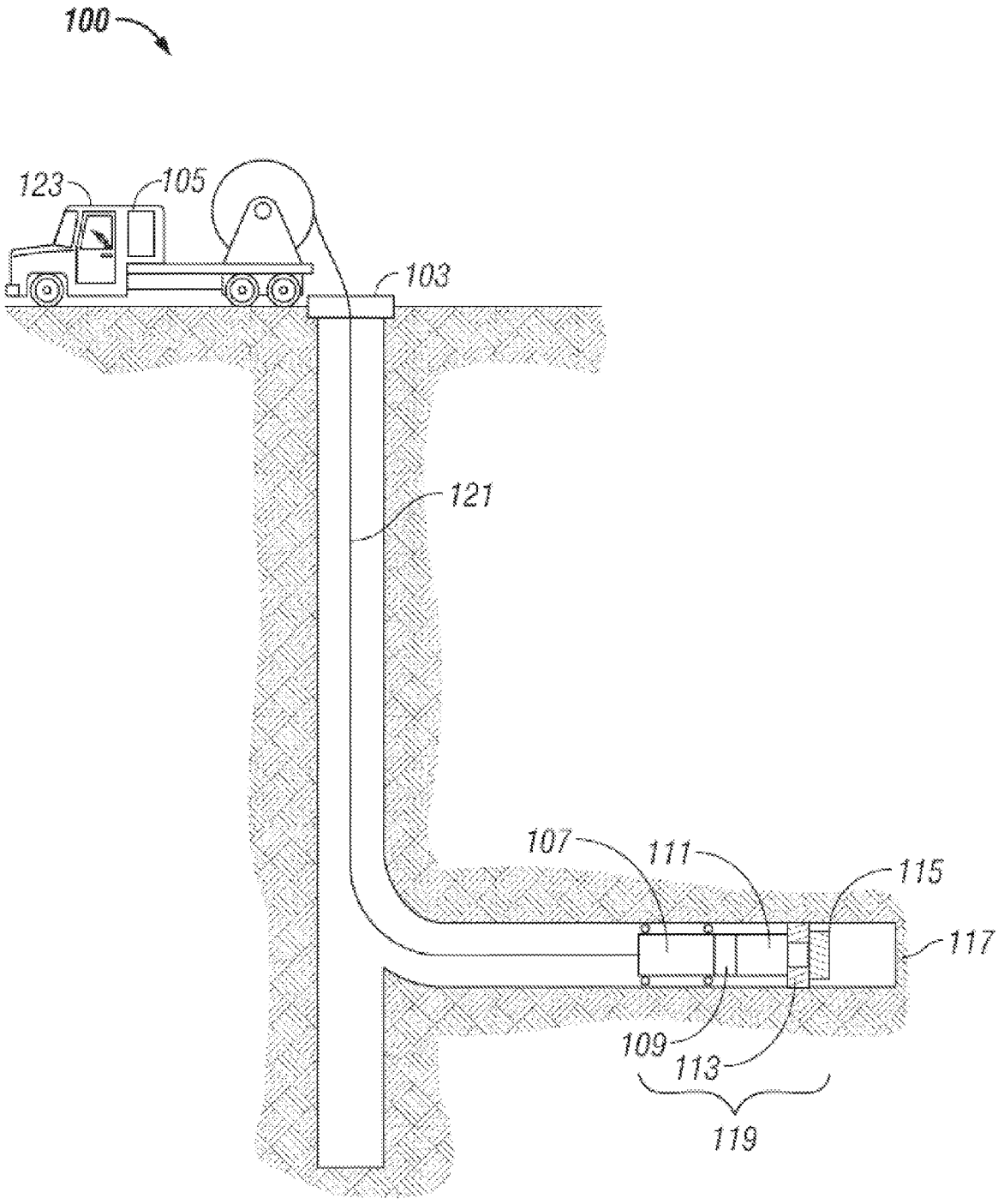
FIG. 1 is a schematic diagram of an embodiment of the invention having a drilling robot with an apparatus for drilling a borehole.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. Additionally, the terms "oil well", "well", "wellbore", "borehole" and variations herein will be used interchangeable to describe the present invention.

The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

I. Introduction

FIG. 1 is a diagram of a borehole drilling system 100 of the present invention having a remotely controlled drilling robot 119. In one embodiment, the drilling robot 119 includes a thrust module 107 used to convey the drilling robot 119 through the rig floor 103 during the drilling operation in a wellbore 117 and to provide thrust to drill bits connected to a drilling module 111. The thrust module 107 is connected to a rotary coupling unit 109. The rotary coupling unit 109 is connected to a drilling module 111. According to the invention, the drilling module 111 supports a drill bit divided concentrically into an inner drill bit 115 and an outer drill bit 113 which are operated in a manner described herein to eliminate the net drill bit torque during drilling operations. The thrust module 107 generates and applies axial force to the drilling module 111 through the rotary coupling unit 109. The thrust module 107, the rotary coupling unit 109 and the drilling module 111 communicate locally to share drilling data and drilling parameters.

In an alternative embodiment, the components of the BHA, e.g., the thrust module 107, communicate with a surface drilling and processing unit 105, for example, located inside a services truck 123, thereby transmitting drilling data to that surface equipment and receiving drilling parameters therefrom as necessary. The surface drilling and processing unit 105, or personnel operating the surface processing unit 105, analyzes the received information and communicates any changes of drilling parameters to the drilling module.

In an alternative embodiment, the drilling robot 119 is connected to the surface drilling and processing unit 105, which may be mounted in a drilling truck 123, via a power cable 121. The thrust module 107 and the drilling module 111 of the drilling robot 119 receive electrical power through the power cable 121. Furthermore, communication between the drilling robot and the surface drilling and processing equipment in drilling truck 123 is transmitted via the power cable 121. In an alternative embodiment, the drilling robot 119 carries a battery pack or other power source. In such an embodiment, the surface drilling and processing unit 105 may communicate wirelessly, for example, via mud pulse telemetry.

II. Drilling Robot

Figure 2:
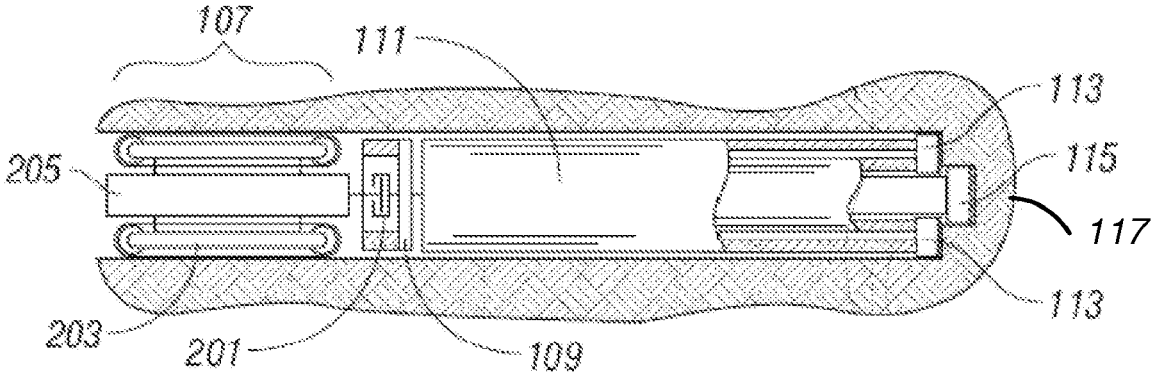
FIG. 2 is a detailed view of one embodiment of the thrust module connected using a rotary coupling to the drilling module illustrated in FIG. 1.

FIG. 2 is a partial cut-away view of one embodiment of the drilling robot 119 illustrated in FIG. 1. An axial thruster 205 of the thrust module 107 is connected using a rotary coupling unit 109 to the drilling module 111. A conveyor 203 of the thrust module 107 provides axial movement of the drilling robot 119 in the wellbore 117. The axial thruster 205 exerts force on the rotary coupling unit 109 to transmit only thrust force from the thrust module 107 to the drilling module 111. By virtue of the rotary coupling unit 109, no reaction torque is transmitted back from the drilling module 111 to the thrust module 107. Rather, should the drilling module 111 begin to rotate due to reaction torque, the drilling module 111 rotates with respect to the thrust module 107. A rotary encoder 201 of the rotary coupling unit 109 provides a signal indicating the rotational relationship between the thrust module 107 and the drilling module 111.

The thrust module 107 and the drilling module 111 are capable of rotating freely with respect to each other. An imbalance in torque between the inner drill bit 115 and the outer drill bit 113 may cause the torque of the drilling module 111 to be non-zero, thereby causing the drilling module 111 to rotate. Because the rotary coupling 109 does not transmit the torque experienced by the drilling module to the thrust module 107, the drilling module 111 rotates independently of the thrust module 107. Permitting such rotation to go unchecked would result in loss of rate of penetration. The thrust module 107 does not experience any torque around its axis when the drilling module 111 is rotating with respect to the thrust module 107, thereby allowing the thrust module 107 to remain rotationally stationary in the wellbore 117 at all times during the drilling operation.

The rotary coupling unit 109 using a rotary encoder 201 as illustrated in FIG. 2 provides the angular position of the drilling module 111 with respect to the thrust module 107. A rotary encoder, also called a shaft encoder, is a digital electronic device that is operable to convert the angular position of a shaft or axle to a digital signal or an analog voltage. The rotary encoder 201 may be, for example, an optical encoder, magnetic encoder, mechanical encoder or a simple potentiometer. The rotary encoder 201 outputs a signal corresponding to the relative angle between the thrust module 107 and the drilling module 111.

Figure 3A:
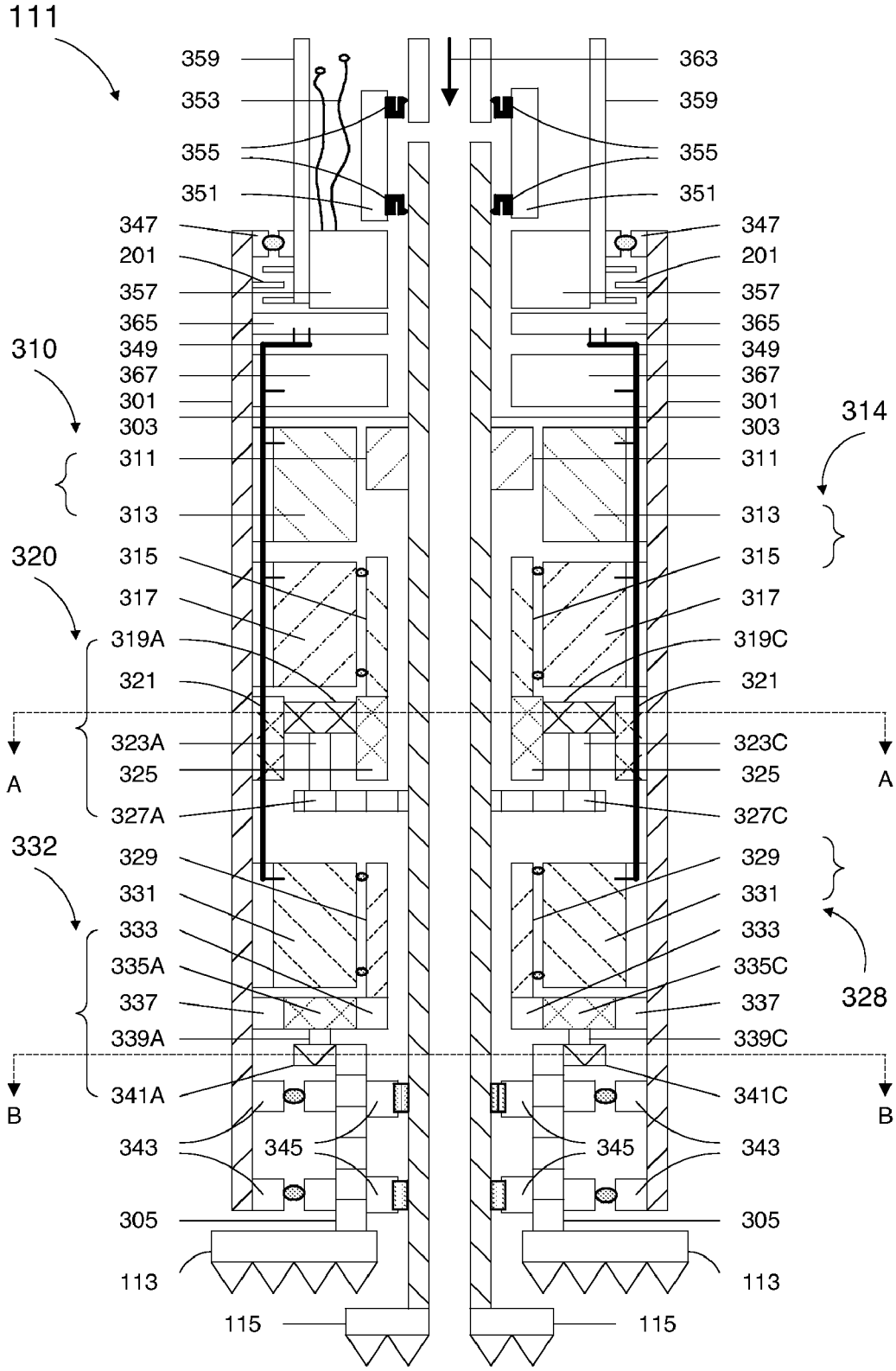
FIG. 3A is a detailed lateral section drawing of an embodiment of the invention having rotary coupling incorporated into the drilling module of the drilling robot illustrated in FIG. 2 wherein the axial thruster of the drilling module is in a retracted position.

FIG. 3A is a lateral cross-section illustration of an embodiment of a drilling module 111 according to the invention having a rotary coupling incorporated into the drilling module 111 of the drilling robot 119 illustrated in FIG. 2 along the axis of the drilling module 111. In this embodiment, the inner drill bit 115, which is connected to an inner drill shaft 303, is operated to rotate in a clockwise direction from a first motor, composed of a rotor 315 and a stator 317, using a planetary gear system 320. The rotor 315, which has a hollow motor shaft, drives an input sun gear 325 of the planetary gear system 320. The planetary gear system 320 consists of several (e.g., four) planet gears 319A-319D (wherein 319B and 319D are not visible in the cross-section view) each of which is connected to a gear shaft 323A-323D respectively and are driven by the sun gear 325. The gear shafts 323A-323D are mounted on a movable planet gear carrier 327A-327D. The planet gear carrier is attached to the inner drill shaft 303. A ring gear 321 of the planetary gear system is connected to a housing 301 of the drilling module 111 and does not rotate. Dotted indicator A-A marks the location of the cross-sectional view in FIG. 4A discussed below.

Figure 4A:
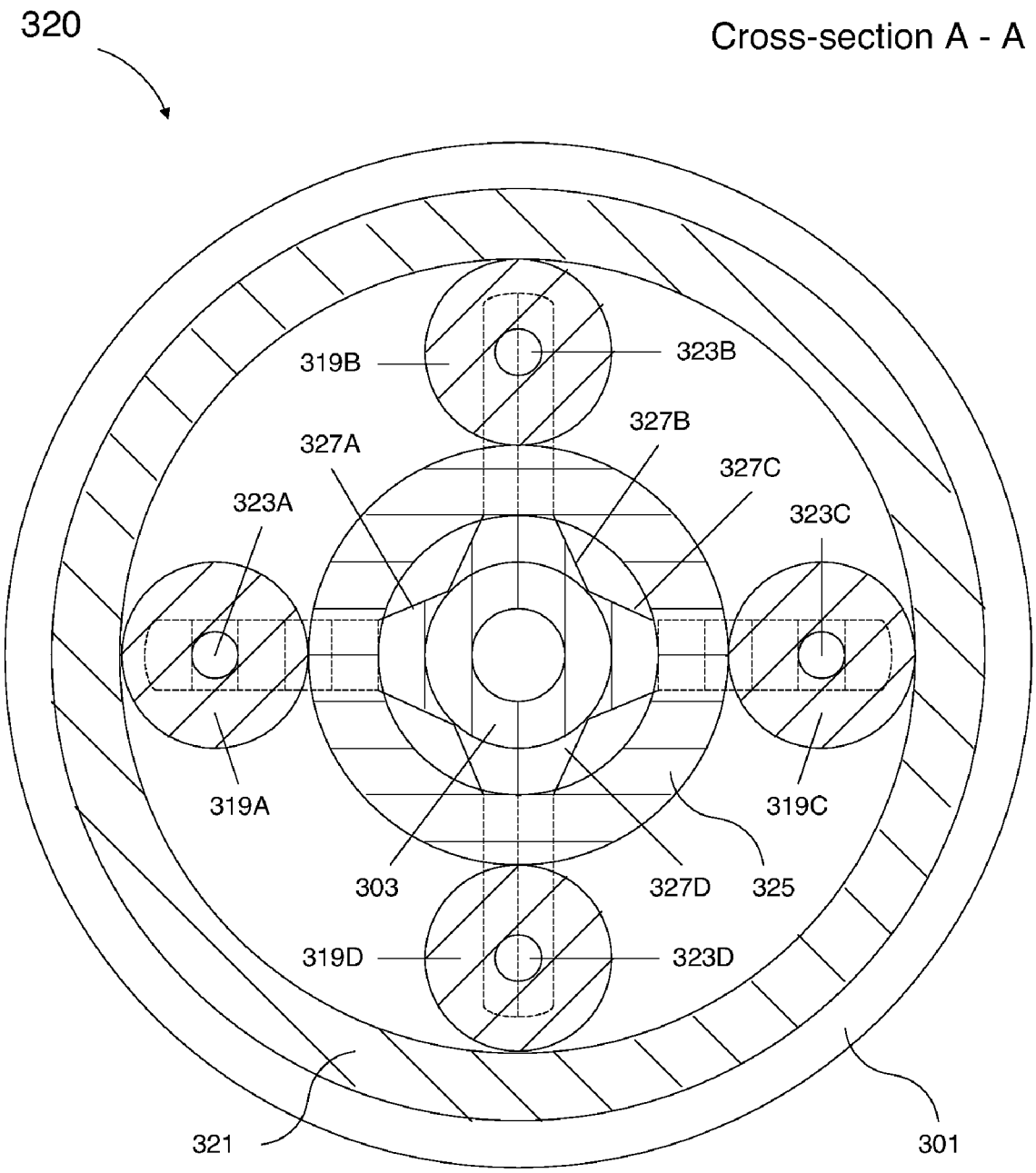
FIG. 4A is a view of cross-section A-A of the drilling module illustrated in FIG. 3A.

FIG. 4A is a cross-sectional view of the planetary gear system 320 used to provide rotation to the inner drill bit shaft 303. The sun gear 325, which is connected to the motor rotor 315, rotates in a clockwise direction and imparts clockwise rotation to the spindles 323. Each spindle 323 is mounted on the planetary gear carrier 327 and is connected to the inner drill shaft 303 as illustrated. Because the ring gear 321 does not rotate, imparting a clockwise rotation to the sun gear 325 results in the planetary gear carrier 327 rotating clockwise. Consequently, because the inner drill shaft 303 is attached to the planetary gear carrier 327, the inner drill shaft rotates in the same direction as the sun gear 325. The planetary gear system 320 is used in one embodiment of the invention because planetary gears provide high transmission ratio in a small design space. In alternative embodiments, other transmission drives may be used such as harmonic drives, cycloidal drives and spur gears.

Referencing once again FIG. 3A, the outer drill bit 113, which is connected to an outer drill shaft 305 is rotated in a counterclockwise direction by a second motor consisting of stator 331 and rotor 329 driving a second planetary gear system 332. One skilled in the art will readily recognize that this is solely a sample embodiment for use with the present invention and is not intended to be limiting in scope. A skilled artisan will readily appreciate that numerous alternative embodiments of the present invention may be used in practicing that which is claimed herein. The rotor 329, which has a hollow motor shaft, drives an outer sun gear 333 of the second planetary gear system 332. The second planetary gear system 332 consists of several (e.g., four) planet gears 335A-335D each of which is connected to a gear shaft 339A-339D respectively and are driven by the sun gear 333. Each of the gear shafts 339A-339D is mounted on a movable planet gear carrier 341A-341D. The planet gear carriers 341A-341D are attached to the outer drill shaft 305. A second ring gear 337 of the second planetary gear system 332 is connected to the housing 301 of the drilling module 111 and does not rotate. Dotted indicator B-B marks the location of the cross-sectional view in FIG. 4B discussed below.

Figure 4B:
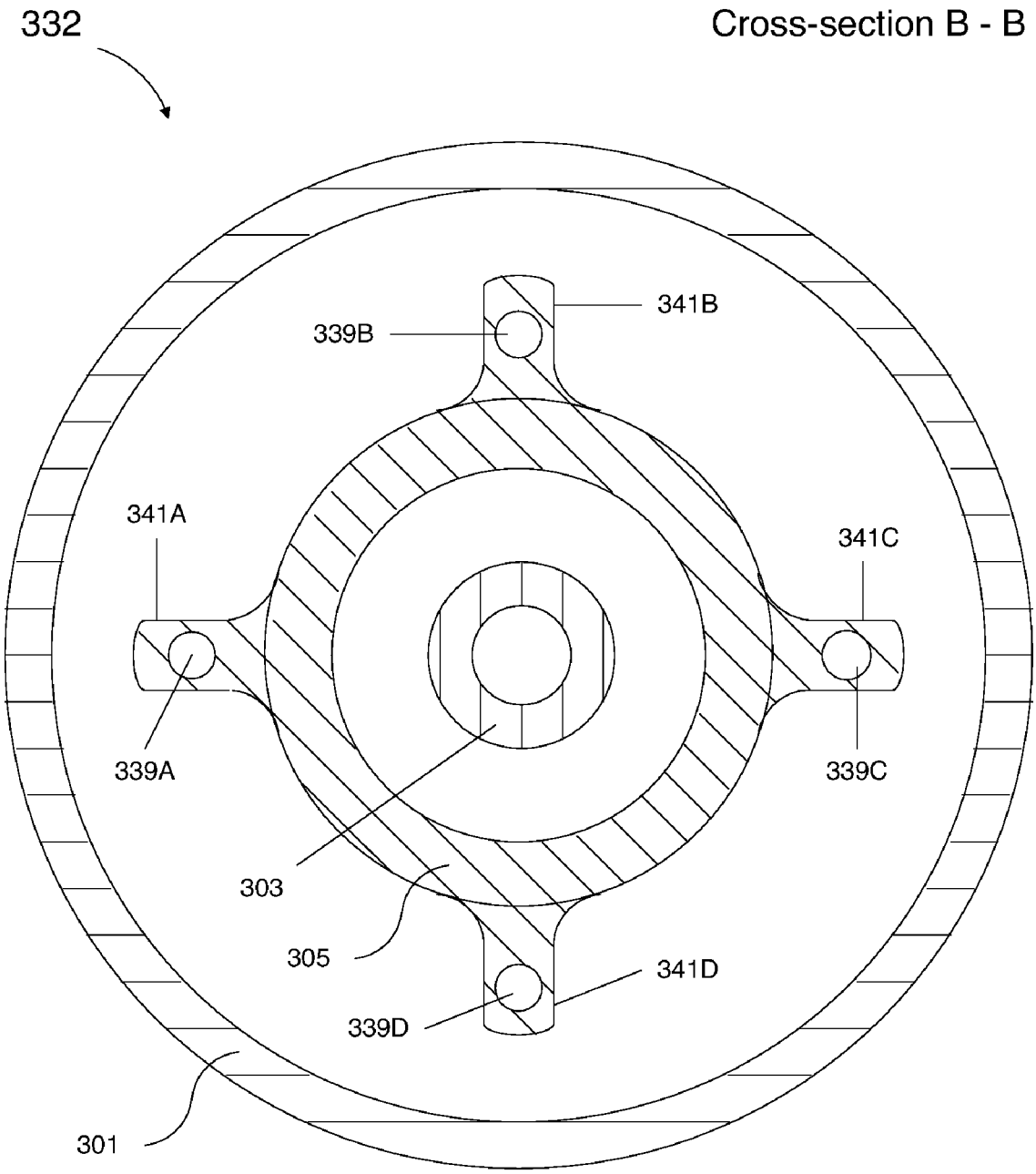
FIG. 4B is a view of cross-section B-B of the drilling module illustrated in FIG. 3A.

FIG. 4B is a cross-sectional view of the drive mechanism for the outer drill shaft along the cross-section B-B of FIG. 3A. Each spindle 339 is mounted on the second planetary gear carrier 341. The outer drill shaft 305 is also connected to the planetary gear carrier 341. Because the second ring gear 337 is stationary, a counterclockwise rotation of the outer sun gear 333 results in the outer drill shaft 305, by virtue of being connected to the second planetary gear carrier 341, to rotate in the same counterclockwise direction as the outer sun gear 333.

Figure 3B:
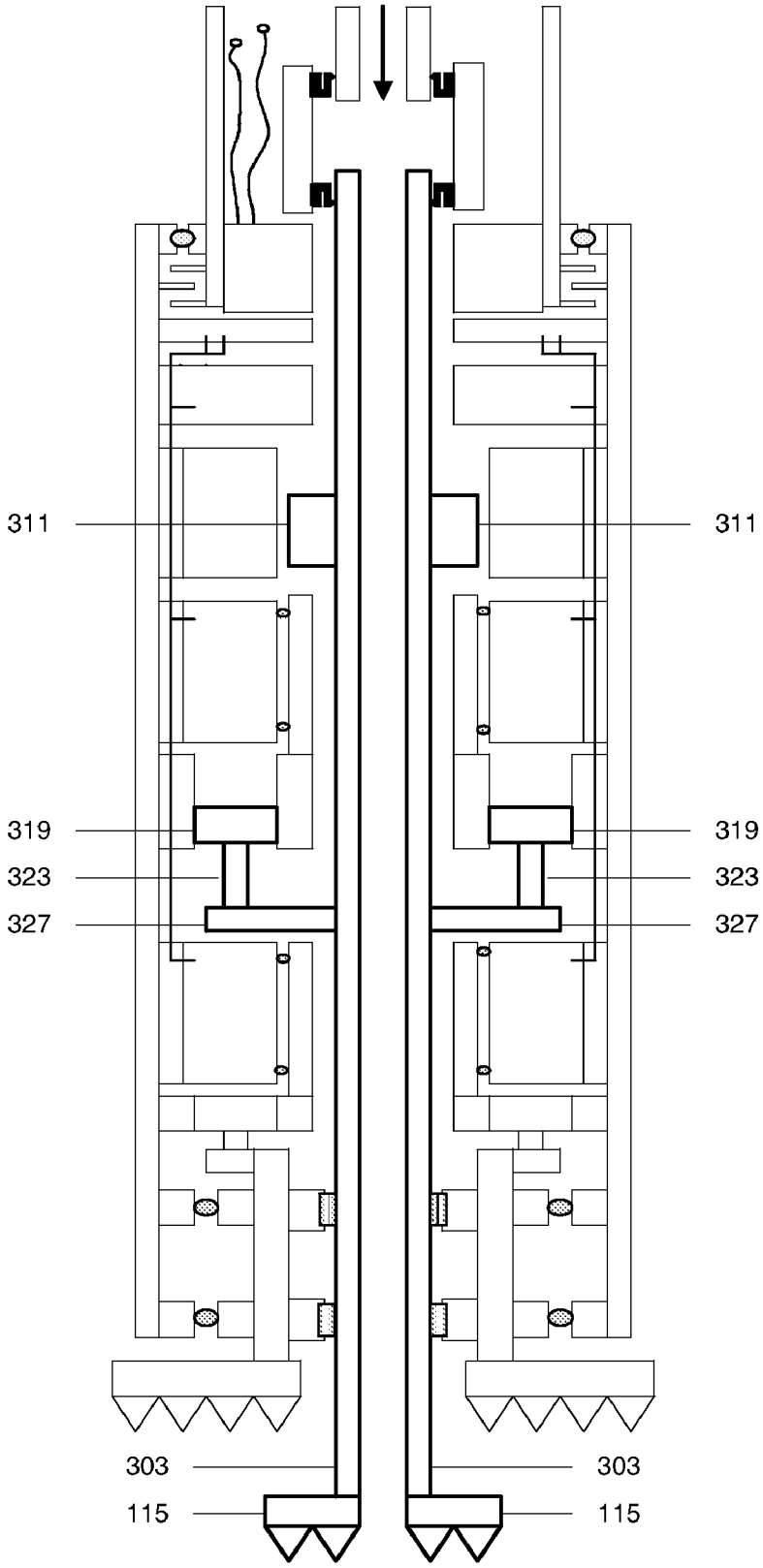
FIG. 3B is also a detailed lateral section view of the drilling module but differs from the view illustrated in FIG. 3A in that the axial thruster of the drilling module pushes the inner drill bit forward, away from the outer drill bit.

Furthermore, in this embodiment, a linear actuator section 310 of the drilling module 111 consists of a movable component 311 attached to the inner drill bit shaft 303 and a stationary component 313, for example, a solenoid linear actuator, attached to the housing 301 of the drilling module. A solenoid linear actuator converts controlled magnetic fields into linear motion of the movable component 311. The linear actuator section 310 provides an axial movement of the inner drill bit 115. FIG. 3A illustrates the inner drill bit 115 in a withdrawn position in which the inner drill bit 115 has been pulled into the drilling module by the axial thruster 311, thus bringing the inner drill bit 115 in closer proximity to the outer drill bit 113 in the wellbore. FIG. 3B is a cross-section illustration of the inner drill bit 115 in an extended position in which the inner drill bit 115 is pushed forward in relation to the outer drill bit 113 by the movable component 311 of the linear actuator in the wellbore.

The inner drill bit shaft 303 is positioned and allowed to rotate inside the outer drill bit shaft 305 on a set of radial bearings 345 as shown in FIG. 3A. The radial bearings 345 are connected to the outer drill bit shaft 305 to allow axial motion during rotation of the inner drill bit shaft 303 when the inner drill bit 115 is retracted inside the drilling module housing 301 or pushed out by the movable component 311 of the linear actuator. Furthermore, the radial bearings 345 serve as rotational bearings for the inner drill bit shaft 303 with respect to the outer drill bit shaft 305.

The outer drill bit shaft 305 is positioned and allowed to rotate inside the drilling module housing 301 on a set of bearings 343.

In an embodiment of the invention, the rotary coupling 109 is incorporated in the drilling module 111 and is supported by the thrust bearings 347 and the mechanical connection 359 with the thrust module. The encoder 201 of the rotary coupling 109 is connected to the drilling module housing 301. Furthermore, the axial thrust in the wellbore from the thrust module 107 is applied to the drilling module 111 through a mechanical connection 359. In this embodiment, mud flow 363 from the thrust module 107 passes through a fluid coupling 351 to the inside of the inner drill bit shaft 303 for drilling operation in the wellbore. A set of seals 355 prevents the mud flow 363 from entering the drilling module housing 301 and allows axial motion to the drilling module 111 while the drill bits are rotating. An electrical connection 353 from the thrust module 107 is routed to a stationary component 365 of a slip ring assembly connected to the drilling module housing 301, which provides electrical connection 349 to all components of the drilling module 111.

A stationary component 357 of the slip ring assembly connected to the thrust module 107 provides communication between the rotary encoder 201 of the rotary coupling 109 and the control module 367 of the drilling module 111 and, furthermore, in an alternative embodiment, the control module 367 provides communication between the surface drilling and processing unit 105 and the drilling module 111, for example, using a mud pulse telemetry system.

Figure 5A:
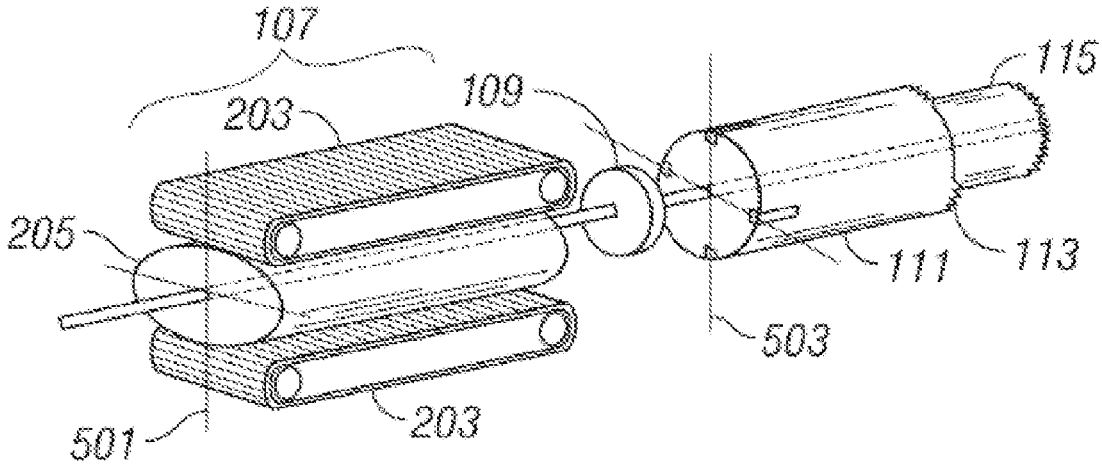
FIG. 5A is a three-dimensional view of the drilling robot illustrated in FIG. 2 wherein the thrust module and the drilling module are rotationally aligned, indicating a straight-ahead drilling of the wellbore.
Figure 5B:
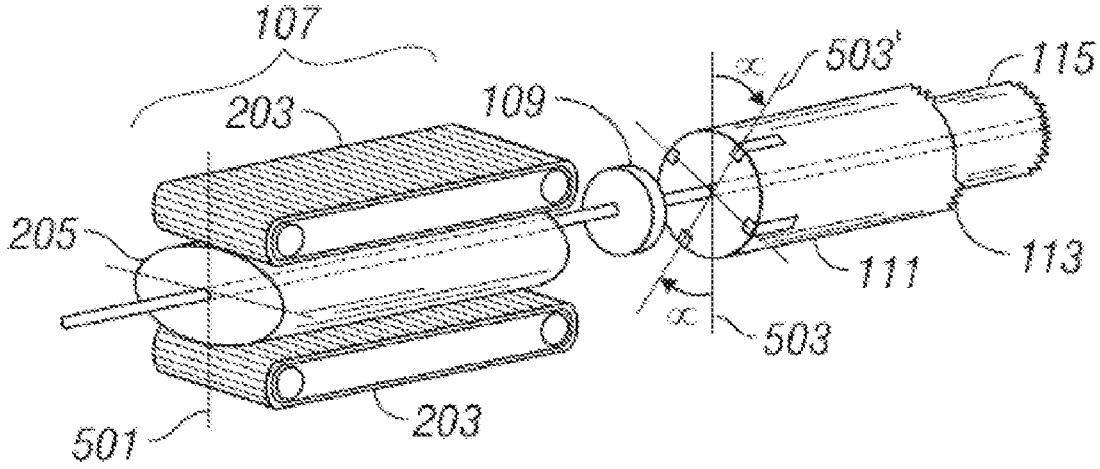
FIG. 5B is a perspective view of the drilling robot illustrated in FIG. 2 wherein the thrust module and the drilling module are not rotationally aligned, indicating that the drilling module has rotated with respect to the thrust module.

FIGS. 5A and 5B are perspective views of the thrust module 107, the rotary coupling 109, and the drilling module 111 of one embodiment of the invention. In FIG. 5A, the drilling module 111 and the thrust module 107 are rotationally neutral with respect to each other, as indicated by the cross-hairs 501 and 503. As described in greater detail herein below, the net torque on the drilling module 111 is controlled. With the net torque on the drilling module 111 eliminated, the thrust module 107 and the drilling module 111 are rotationally stationary in the wellbore and, furthermore, the position relative to the rotational axis of the thrust module 107 (indicated by cross-hairs 501) is aligned with the position relative to the rotational axis of the drilling module 111 (indicated by cross-hairs 503). The rotary encoder 201, for example, as illustrated in FIG. 2, may be housed in the rotary coupling 109 and provides a signal indicating the angular relationship of the thrust module 107 and the drilling module 111. Thus, because the thrust module 107 and the drilling module 111 are aligned as shown in FIG. 5A, the rotary encoder 201 provides the drilling module with a signal showing a neutral alignment between the thrust module 107 and the drilling module 111.

In FIG. 5B, the drilling module 111 has rotated with respect to the thrust module 107 along their common axis by an angle $\alpha$ due to an external disturbance. Thus, the angular relationship between the drilling module 111 and the thrust module 107 along their common axis after that rotation is an angle $\alpha$ illustrated by the new cross-hairs 503' in relation to cross-hairs 503. The rotation $\alpha$ may be due to an imbalance in torque between the outer drill bit 113 and inner drill bit 115. Consequently, the rotary encoder 201 communicates to the drilling module 111 by sending a signal indicative of an angle $\alpha$ between the thrust module 107 and the drilling module 111. In response to the signal input from the rotary encoder 201 indicating that a rotation has occurred, the drilling module 111 adjusts the weight on bit distribution between the inner drill bit 115 and the outer drill bit 113, i.e., the axial thrust asserted by the linear actuator section 310 of the drilling module 111 is adjusted, or adjusts the relative RPM of the motors driving the inner drill bit 115 and outer drill bit 113, respectively, in order to internally restore balance to all drilling torques and eliminate rotation of the drilling module 111.

The torque on a drill bit is not only a function of the weight-on-bit, but also a function of the rate of rotation of the inner drill bit 115 and the outer drill bit 113. Accordingly, the net torque can be controlled by changing the rate of rotation of either the inner drill bit 115 or the outer drill bit 113, or both.

In an alternative embodiment, a directional drilling tool includes a counter rotational drilling bit to control the reactive drilling torque and intentionally increases or reduces reactive drilling torque for the purpose of controlling drill bit walk to alter the desired direction of the drilling in a wellbore. In that embodiment, the control module 367 of the drilling module 111 communicates with the surface drilling and processing unit 105 to receive information related to the direction of the drilling robot in the wellbore. Sensing the direction during a drilling operation is well known in the art using, for example, a direction and inclination package incorporating an accelerometer to detect the inclination and a magnetometer to detect the direction.

Figure 6A:
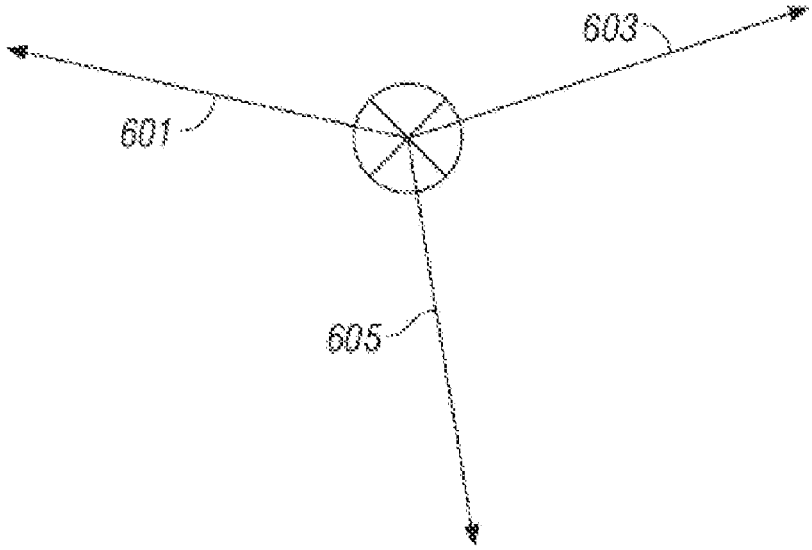
FIG. 6A is a vector diagram illustrating an exemplary balance of the vector forces used to drill a straight wellbore.

FIG. 6A is a schematic illustration of the drilling forces represented as vectors. The direction processing component of the control module 367 combines and manipulates these vectors to control the drill bit walk thus achieving the desired direction of drilling. The force resulting from the rotation of the inner drill bit 115 is represented by vector 601, the force resulting from the rotation of the outer drill bit 113 is represented by vector 603, and the force resulting from the weight on drill bit is represented by vector 605 (collectively, the "drilling forces"). In FIG. 6A, the drilling forces are balanced; consequently, the direction of the drilling of the wellbore is straight ahead. To continue drilling straight ahead the balance of the force vectors is maintained in equilibrium. If drilling straight ahead is desired and the equilibrium is not maintained, the force vectors are adjusted by manipulating the relative rotational speed of the inner drill bit 115 and the outer drill bit 113 or the weight on the inner drill bit 115.

Figure 6B:
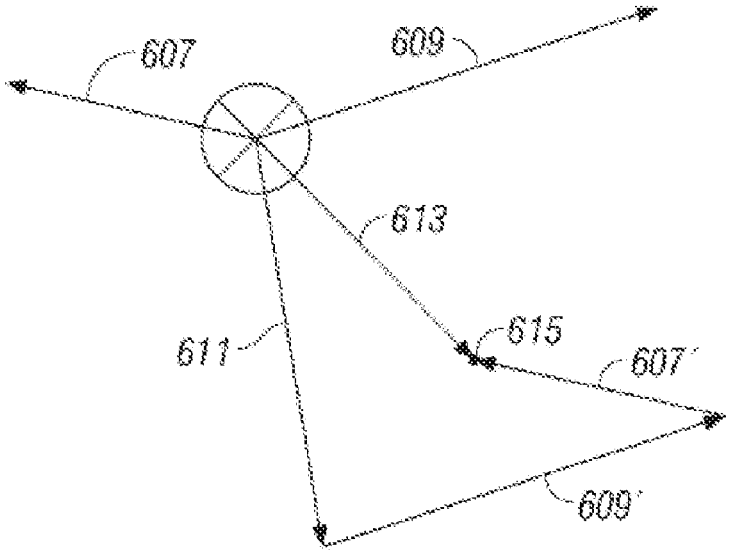
FIG. 6B is a vector diagram illustrating unbalanced vector forces that produce a resultant vector deviating from the straight-ahead drilling trajectory.

FIG. 6B is a schematic illustration of force vectors that occur when the drilling forces are not in balance. The force resulting from the rotation of the inner drill bit 115 is represented by 607, the force resulting from the rotation of the outer drill bit 113 is represented by 609, and the force resulting from the weight on drill bit is represented by 611. The resultant vector 613 (from an addition of the vector 609' and the vector 607' to the vector 611) represents the direction in which drill bit walk would be expected given this particular balance of forces.

Thus, in this alternative embodiment, the desired drilling direction is achieved by manipulating the relative rotational speed of the inner drill bit 115 and the outer drill bit 113 as well as the weight on the inner drill bit 115. Furthermore, the outer drill bit rotation in the opposite direction from the inner drill bit adds an additional walk tendency vector whose magnitude can be adjusted by controlling the weight-on-bit and the rate of rotation of one or both drill bits. In one alternative embodiment, an operator may indicate a position 615 to which the drilling apparatus should steer. The position 615 is then communicated to the drilling module 111. Software in the drilling module 111 determines the required vectors to arrive at the position 615. For example, if drilling straight ahead as in FIG. 6A and desiring to change direction to point 615, the vector 601 may be reduced to correspond to the vector 607, i.e., because vectors 601 and 607 correspond to the force of the inner drill bit 615, the rotational speed of the inner drill bit 615 is reduced.

III. Workflow

The characteristics of a single drill bit can be described by mathematical relationship as illustrated in equations (1), (2) and (3) between torque (T), weight on bit (WOB), depth of cut ($d_c$), rate of penetration (ROP) and rotational speed (RPM).

$$T=C_T*d_c+T_0 \quad \text{(Equation 1)}$$

$$WOB=C_W*d_c+WOB_0 \quad \text{(Equation 2)}$$

$$d_c=ROP/RPM \quad \text{(Equation 3)}$$

The constants $C_T$, $C_W$ are dependent on the type of rock and rock properties such as breaking strength. $T_0$ represents the component of the torque caused by pure friction. $WOB_0$ represents minimum weight required for the drill bit to go from simply rubbing the rock formation in the wellbore to actually cutting the rock. By eliminating the depth of cut dependency from Equations (1) and (2) set forth above, the torque is represented as $T=(C_T/C_W)*(WOB-WOB_0)+T_0$. In a homogeneous state $C_T$, $C_W$, $T_0$ and $WOB_0$ do not change. Consider a drilling apparatus in which the WOB is kept constant. In such an environment, i.e., homogenous formation and constant WOB, the torque at the single drill bit is independent of the rotational speed. Therefore, the torque cannot be controlled by changing the rotational speed. In a scenario wherein a constant ROP can be applied to this single drill bit system, for example, using the thrust module 107, results in the torque on the single drill bit to be inversely proportional to the rotational speed, i.e., $T=C_T*(ROP/RPM)+T_0$.

The aforementioned mathematical representation can be extended to the concentrically arranged inner and outer drill bits described herein as illustrated below.

$$T_1=C_{T1}*(ROP/RPM_1)+T_{01} \quad \text{(Equation 4)}$$

$$WOB_1=C_{W1}*(ROP/RPM_1)+WOB_{01} \quad \text{(Equation 5)}$$

$$T_2=C_{T2}*(ROP/RPM_2)+T_{02} \quad \text{(Equation 6)}$$

$$WOB_2=C_{W2}*(ROP/RPM_2)+WOB_{02} \quad \text{(Equation 7)}$$

$$Thrust_{total}=WOB_1+WOB_2 \quad \text{(Equation 8)}$$

Each bit of the concentrically arranged drill bit has its own rock cutting property constants, i.e., $C_{T1}$, $C_{T2}$, $C_{W1}$, $C_{W2}$, $T_{01}$, $T_{02}$, $WOB_{01}$ and $WOB_{02}$. The control module 367 of the drilling module 111 balances the torque $T_1$ and $T_2$. The torque $T_1$ and $T_2$ are balanced so that they are not necessarily at a constant value. However, they are equal and opposite. The torque experienced by the drilling module 111 is represented by $T_{DM}=T_1-T_2$. Thus, when the torque $T_1$ and $T_2$ are equal, the drilling module 111 does not rotate in the borehole.

Figure 7:
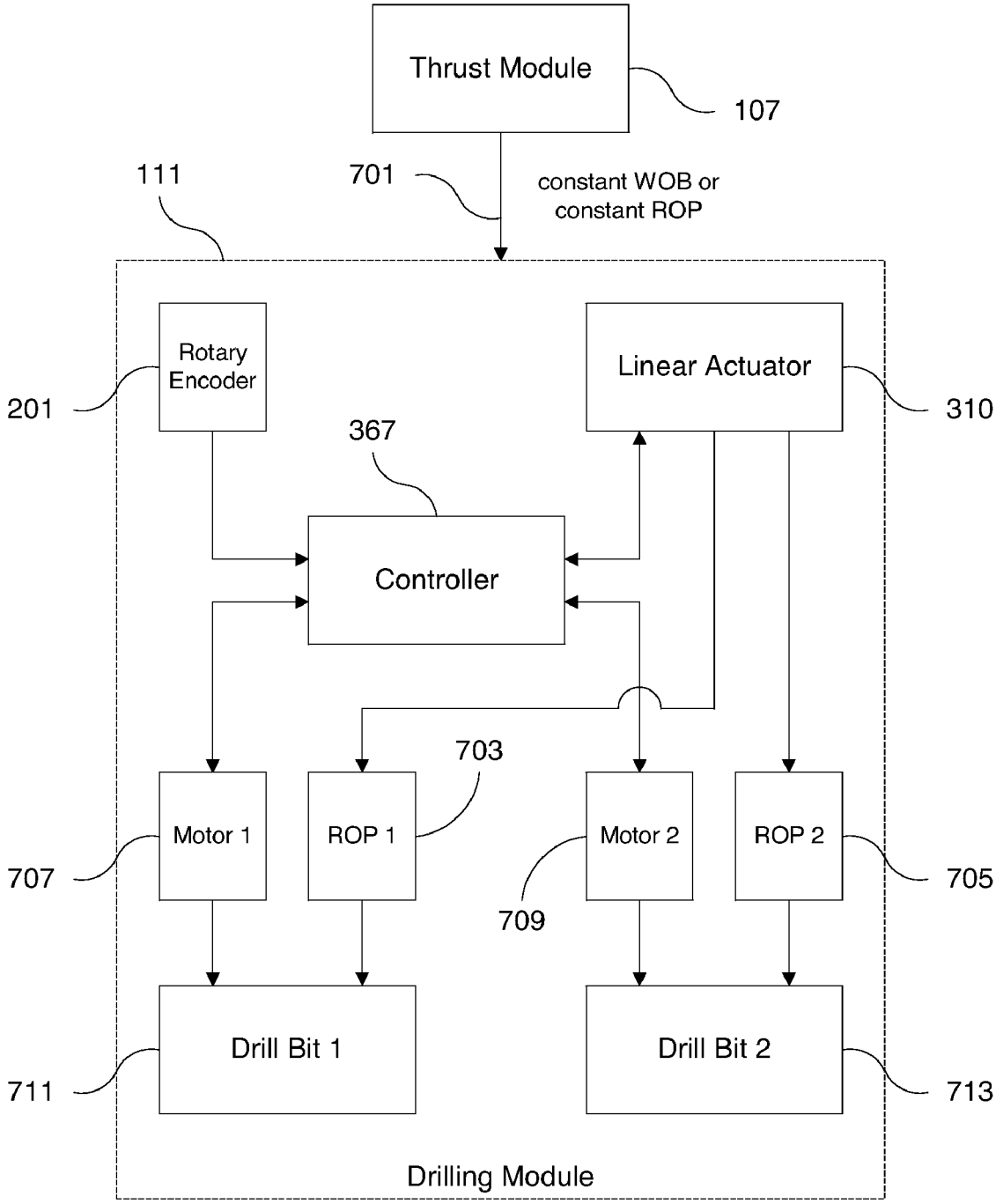
FIG. 7 is a flow-chart illustrating an exemplary method for using a drilling module angular position analysis tool to control or eliminate reaction torque according to one embodiment of the present invention.

FIG. 7 is a schematic illustration of a possible workflow for the drilling module 111 in which drilling torque, and consequently relative rotation between the drilling module 111 and thrust module 107, is controlled. The rotary encoder 201 of the rotary coupling unit 109 determines the angular relation (also called relative rotation) of the drilling module 111 with respect to the thrust module 107 and transmits a digital signal indicative of the angular relationship to the control module 367. In alternative embodiments, the signal indicative of relative rotation could also come from any other geostationary or quasi-geostationary reference, i.e., not necessarily from a rotary encoder 201. The control module 367 of the drilling module 111 receives the signal from the rotary encoder 201 (or alternative source) indicative of the angular relationship between the thrust module 107 and the drilling module 111 and uses that information to determine if the drilling module 111 had begun to rotate with respect to the thrust module 107. Furthermore, the control module 367 receives information regarding current RPM of the inner drill bit motor and outer drill bit motor.

The thrust module 107 applies axial thrust, step 107, i.e., either constant WOB or constant ROP to the drilling module 111 to continue drilling process in the wellbore. The relative rotation of the drilling module 111 with respect to the thrust module 107 along their common axis is acquired using any method suitable for obtaining angular position, for example, using the rotary encoder 201. The control module 367 of the drilling module 111 evaluates the angular position information received from the rotary encoder 201 to determine whether the drilling module 111 has begun to rotate with respect to the thrust module 107. To counteract the rotation, e.g., the weight on inner drill bit 703 is adjusted by causing the inner drill bit 115 to be moved axially by the linear actuator 310 or by adjusting the relative RPM of the drill bits.

The selection of parameters to adjust may be made according to any of many different strategies. In one embodiment of the invention, the ROP of the inner-and outer-drill bits is fixed with respect to each other, i.e., the $ROP_1$ is equal to $ROP_2$. In other words, the linear actuator 310 is not involved (except as described herein below). In this embodiment, the relative torque of the inner- and outer-drill bits are adjusted by manipulating the relative RPM of the two motors driving these drill bits, respectively. (Because the RPM of either the inner drill bit 115 or the outer drill bit 113 may be held constant and the other adjusted, FIG. 7 depicts these generically as first and second drill bits 711 and 713, respectively. Similarly, first motor 707 and second motor 709 may correspond to either the motor driving the inner drill bit 115 or the outer drill bit 113.)

A feed-back control loop is used to keep one of the motors, e.g., the first motor 707, at a near-constant RPM. Consider, for example, the first motor 707 as being designated to operate at a constant RPM relative to which the RPM of the second motor 709 is adjusted to control the relative torque exerted by the two drill bits 711 and 713. The RPM of the first motor 707 is then fed back to the control module 367. The control module 367 adjusts the power applied to the first motor 707 to keep that motor operating at a near-constant RPM. The feed back control loop to control the speed of the first motor 707 may, for example, be a PID (proportional-integral-derivative) controller.

Figure 8:
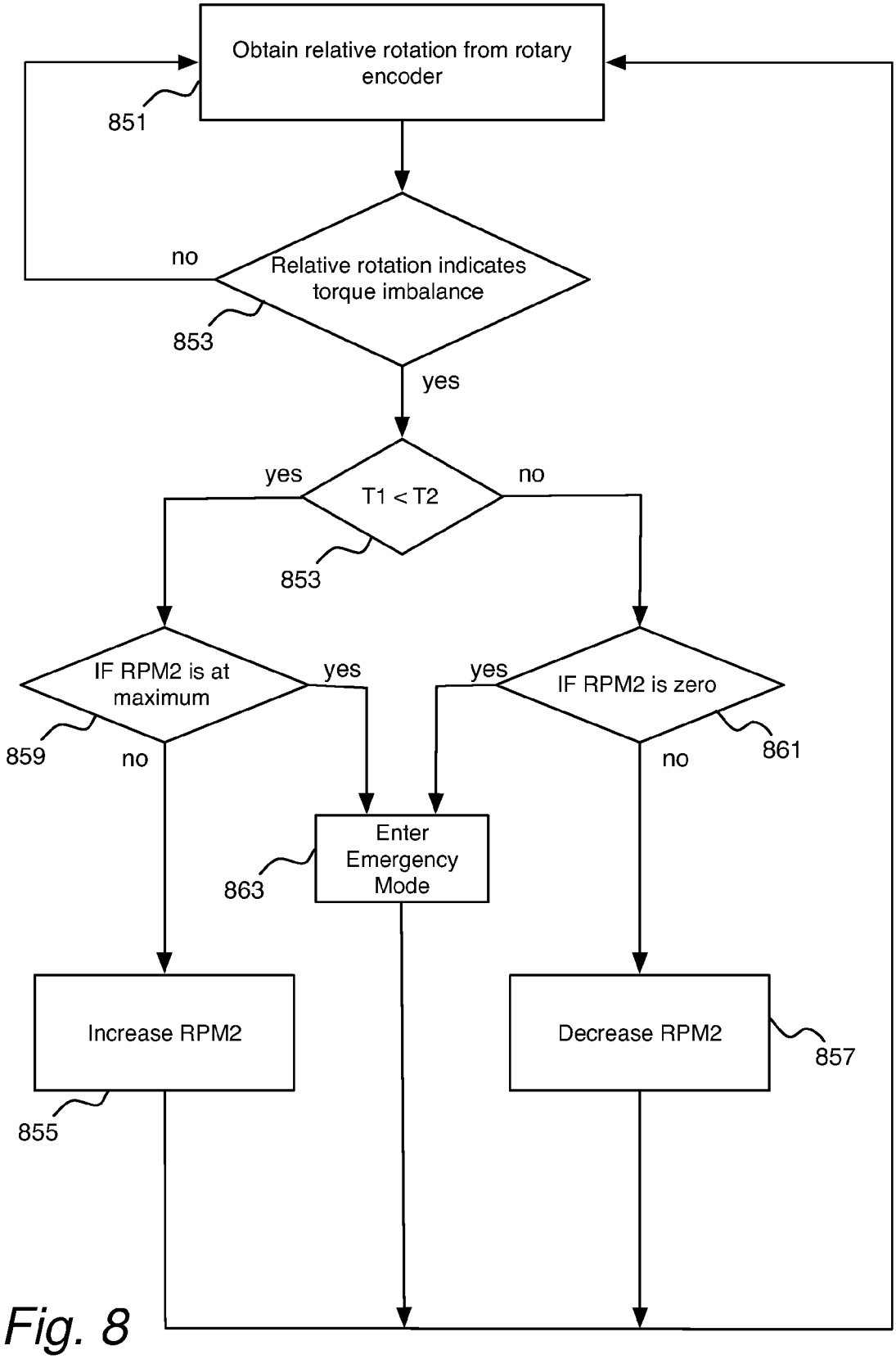
FIG. 8 is a flow-chart illustrating an exemplary method for using a drill bit direction analysis tool to control relative torque on two concentric drillbits by maintaining the RPM of one motor at a constant or near-constant RPM while controlling the RPM of the other motor to keep the torque exerted on the two drillbits balanced.

FIG. 8 is a flow-chart illustrating an embodiment of the control module 367 software in which RPM of one of the two motors 707 and 709 is used to control the relative torque from the two concentric drill bits. The control module 367 continuously receives the relative rotation from the rotary encoder 201, step 851. If the relative rotation indicates the torques are in balance, i.e., there is no rotation, step 853, the control simply returns to again read a new relative rotation from the rotary encoder, step 851. This loop continues until the torques are not in balance, step 853, at which time the relative RPM is adjusted. If the relative rotation indicates that the torque on the second drill bit 709 is greater than the torque on the first drill bit 711, step 853, the RPM of the second drill bit 709 should be increased, step 855. If the RPM on the second drill bit 709 is increased, except for the condition that the ROP of both bits is held to be the same, the ROP of the second drill bit 713 would also increase. However, because the RPM on the first drill bit 711 is held near-constant, the ROP of the first drill bit 711, increased ROP increases the WOB as well as the torque on the first drill bit 711. On the other hand, because the increase in RPM of the second drill bit 713 does not achieve the increase in overall ROP that would have been achieved by the second drill bit in isolation, the WOB of the second drill bit 713 decreases, and, consequently, also the torque on the second drill bit 713. Accordingly, when the torque of the second drill bit is greater than the torque on the first drill bit, the RPM of the second motor may be increased to decrease the torque on the second drill bit while increasing the torque on the first drill bit.

Conversely, if the relative rotation indicates that the torque on the second drill bit 709 is not greater than the torque on the first drill bit 711, step 853, the RPM of the second drill bit 709 should be decreased, step 857.

However, naturally if the RPM is either at a maximum, step 859, or already zero, step 861, some other corrective action must be taken. In that case, an emergency mode 863 is entered. Controlling the operation of the drilling module may fail due to certain external disturbances. For example, one of the drill bits may have encountered a very hard material, e.g., granite, while the other drill bit is drilling in a soft material, e.g., sand. In such a case, altering the RPM may not be sufficient to control the relative torque exerted by the drill bits. Therefore, in response to such a condition the emergency mode is initiated by the control module. In the emergency mode, the linear actuator 310 is used to generate an inchworm type motion to restore normal operation of the drilling module. The motors of the inner drill bit 115 and the outer drill bit 113 are intermittently turned on and off along with the linear actuator 310 advancing in the borehole resulting in the weight on bit being applied alternately to the inner drill bit and the outer drill bit. This repeated continuous movement of the drill bits and the linear actuator is referred to as an inchworm type of motion and furthermore restores normal mode of the drilling module.

Figure 9:
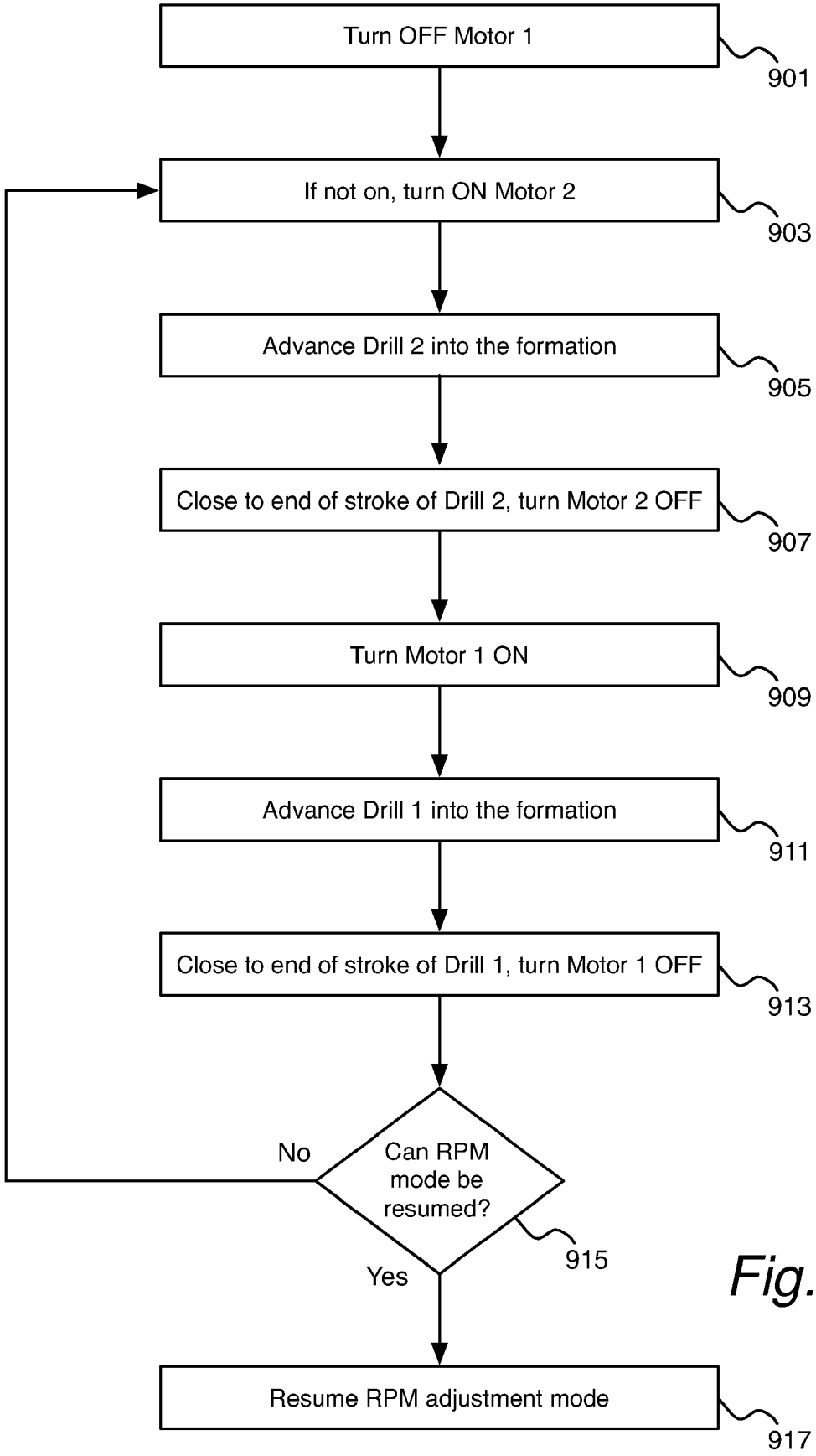
FIG. 9 is a flow-chart illustrating an emergency mode entered into by the drilling module when RPM adjustments alone cannot control relative torque, for example, as may occur when the two drillbits are encountering materials with relatively large disparity in hardness.

FIG. 9 is a flow-chart illustrating the emergency mode 863 of FIG. 8. The emergency mode may be entered when an external disturbance causes the drilling control system described herein above to fail. In the emergency mode, the linear actuator 310 is used to inch-worm the drilling robot forward in the drilling operation. In one embodiment of the emergency mode 863, the drilling control module 367 first turns off the first motor 707, step 901. This step (step 901) causes the entire thrust load to be rested on the first drill bit 711. The second motor 709 is then turned on, step 903, and the second drill 713 bit is advanced into the formation using the linear actuator 310, step 905. In one embodiment the rate at which the second drill bit is advanced in the emergency mode is set as an operator parameter. The RPM at which the second drill bit is rotated may be maintained using a PID control loop. In the emergency mode, the maximum torque that may be applied by the rotating drill bit, here the second drill bit 713, is a function of the holding torque of the stationary drill bit. In accordance with one embodiment of the present invention, the torque of the rotating drill bit may be less than the holding torque. Otherwise, the stationary bit begins to slip. From the equations above, it follows that:

$$T_{drill}=C_{Tdrill}*(ROP/RPM_{drill})+T_{0drill} \quad \text{(Equation 9)}$$

where "drill" is the index of the rotating drill, e.g., in steps 903 and 905, it is 2.

The $RPM_{drill}$ is adjusted so that Tdrill<Thold. As a practical matter, this may be achieved by adjusting the $RPM_{drill}$ if a slippage is detected on the stationary bit (slippage would be indicated by detecting a rotation of the drilling module 111).

When the linear actuator 310 has advanced the second drill bit 713 by the full range of motion of the linear actuator 310 (or nearly the full range of motion), the second motor 709 is turned off, step 907. The first motor is then turned on and its rotation is maintained using, for example, a PID control loop, step 909. The first drill bit 711 is now advanced into the formation using the linear actuator 310, step 911. At the end of (or near the end of) the stroke of the linear actuator 310, the first motor 711 is turned off, step 913.

The possibility to return to RPM mode is periodically tested, step 915, for example, at the end of each complete cycle of moving the second motor, steps 905 and 907, and moving the first motor, steps 911 and 913 into the formation. In one embodiment, testing to determine whether emergency mode may be exited is performed by successively increasing the RPM on each iteration through the loop until the stationary bit slips. For the bit with less resistance, the RPM can be much higher than for the bit with higher resistance. Therefore, while the difference between the respective RPMs that may be sustained without slipping the stationary bit is large, emergency mode will be required. However, as the two possible RPMs become closer to one another, i.e., the difference is less than a set threshold, emergency mode may be exited and RPM adjustment mode may be reentered.

Figure 10:
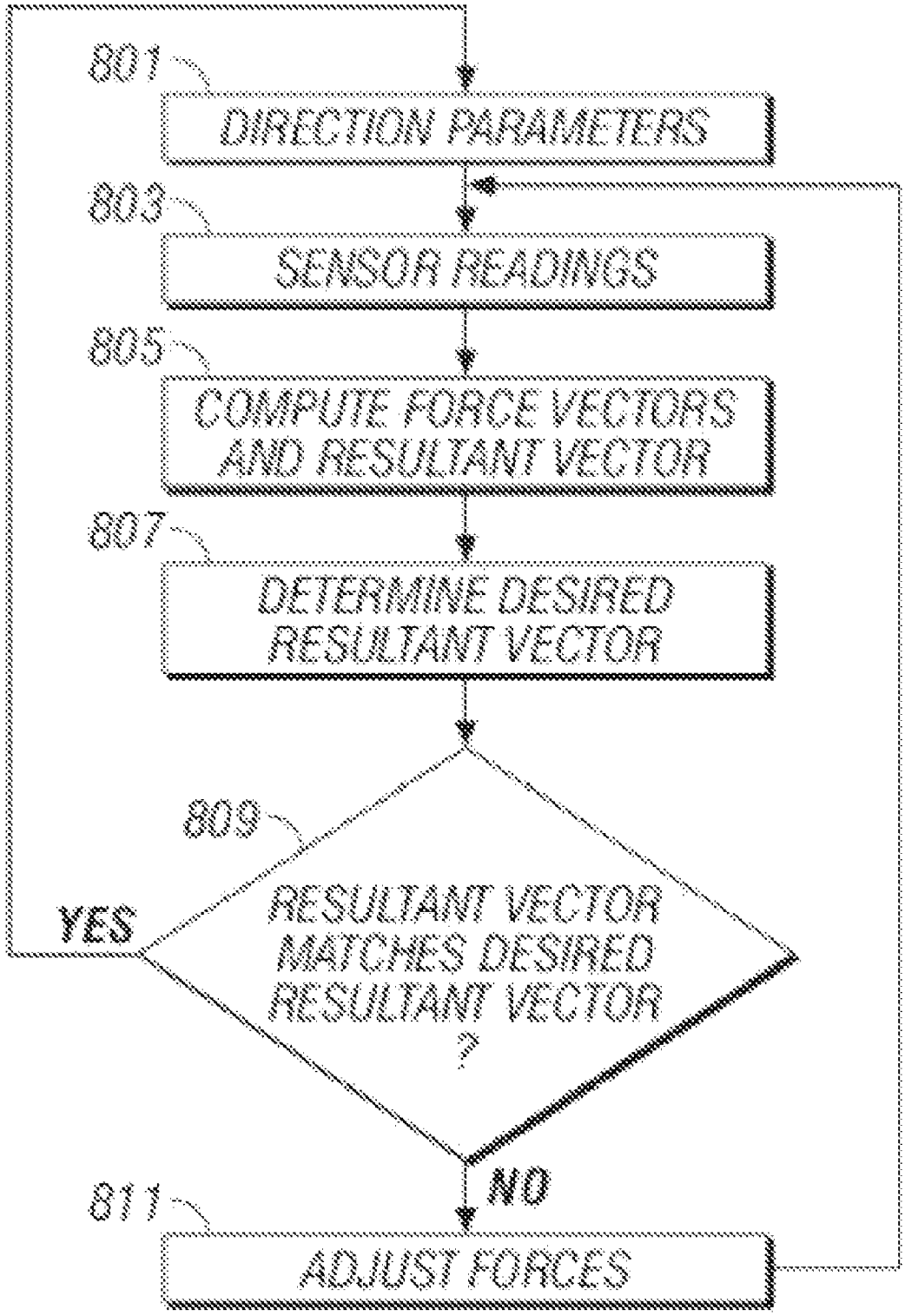
FIG. 10 is a flow-chart illustrating an exemplary method for using a drill bit direction analysis tool to steer a drilling operation according to an alternative embodiment of the present invention.

In an alternative embodiment of the invention, the drilling module 111 is used to control the steering direction of the drilling operation. FIG. 10 is a flow-chart illustrating a possible workflow for an alternative embodiment in which the drilling module 111 described herein is used to steer the drilling direction. As a first step, the drilling module 111, for example, the control module 367, receives drilling direction parameters, for example, a desired new direction for the borehole trajectory, step 801. These drilling parameters may be transmitted from the surface equipment 105, which could be, for example, located inside the oil field services truck 123, to the drilling module 111, using mud pulse telemetry or on a power cable 121 connecting the surface process equipment 105 and the drilling robot 119. In one embodiment of the invention, the drilling module 111 is connected to conventional drill pipe and receives thrust from the drill pipe. The adjustments on the relative torque of the inner and outer drill bits are used to achieve a particular desired trajectory by inducing drill-bit walk.

The drilling module 111 reads torque and weight-on-bit sensors to determine the torque on the inner drill bit 115, the torque on the outer drill bit 113, and the weight-on-bit for the inner drill bit 115, step 803. In an alternative embodiment, the mud flow rate and weight-on-bit for the inner drill bit 115 and outer drill bit 113 are recorded by the surface drilling and processing unit 105. Furthermore, the flow rate may be measured by the speed of the surface mud pump and displacement of the mud and communicated to the surface drilling and processing unit 105. In this embodiment, the drill pipe provides the clockwise rotation to the outer drill bit providing a force vector from the axis as together with weight on bit in most rock formation in the borehole will result in a tendency for drill bit walk. A mud motor provides counter clockwise rotation to the inner drill bit and rotation of the inner drill bit is controlled by the mud flow-rate. By balancing the weight on bit on the inner drill bit as the weight on bit on the outer drill bit along with an imbalance of the relative torque from the rotation of the inner drill bit and the outer drill bit (rotating in opposite direction with respect to one another) provides a non-neutral force vector. In conjunction with the design of the two drill bits, the varying weight on bit provides the third force vector. In the exemplary embodiment, the surface drilling and processing unit 105 determines if correction is needed to the direction parameters by analyzing the force vectors and resultant vector as illustrated in FIG. 6, step 805. Next, the desired resultant vector is determined, step 807. If there is a match between the desired resultant vector and the resultant vector from the current drilling forces, step 809, the process may return to the step of waiting for new direction parameters, step 801. Otherwise, the drilling forces are adjusted, step 811, and the steps of reading the force sensors, computing current resultant force vector and comparing to desired resultant vector are repeated. By measuring the drilling forces and adjusting as necessary to match a desired resultant force vector, the drilling and processing unit 105 controls the drill bit walk, thereby using the drill bit walk to steer the drilling operation along a desired trajectory in the wellbore. The drilling and processing unit tracks the adjustments to the direction parameters and its effect on the trajectory followed by the drilling robot. This learning process allows future adjustments to the direction parameters whereby a pre-defined trajectory is maintained by the drilling robot. The learning process also allows the data concerning adjustments and success with trajectory to be used in future drilling operations in similar earth formations and drilling conditions.

IV. Schematic

Figure 11:
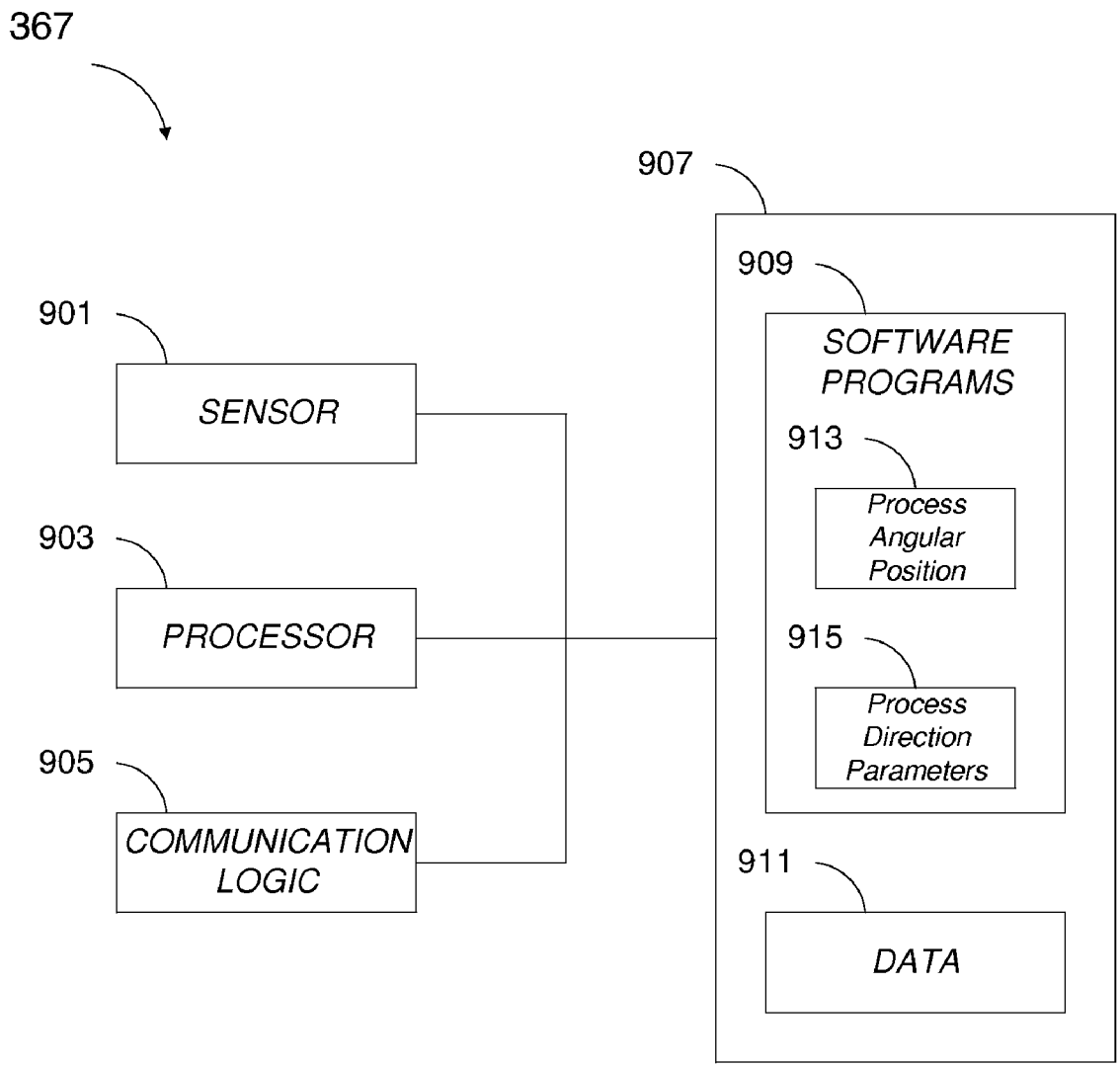
FIG. 11 is a schematic illustration of the drilling module processing section of a drilling module according to the invention.

FIG. 11 is a schematic illustration of the control module 367 of the drilling module 111. One or more sensors 901 are connected to a processor 903. The processor operates according to program instructions of a software program 909 stored in a memory 907. The software program 909 is an implementation of at least a portion of the work flows illustrated in FIG. 7 through 10 and the method of controlling torque described hereinabove in conjunction with the other figures. In other words, the software programs 909 may include a module 913 to implement an algorithm as discussed hereinabove to process the relative angular position of the drilling module 111 and the thrust module 107 and to use that information to control the torque so as to minimize or, ideally, eliminate the rotation. Alternatively, the software programs 909 provide an implementation 915 of the algorithms discussed hereinabove to process direction parameters to control the drill bit walk to achieve a desired drilling direction. The memory 907 may also contain an area for storing data 911, for example, parameters for controlling the control module 367, e.g., set points for the RPM for the motor having a constant RPM, the rate of advancement of the linear actuator during emergency mode, desired direction for directional control. In an alternative embodiment of the invention, the control module 357 is located in the surface equipment or even off-site. The control module 367 of the drilling module 111 may also contain communication logic 905 for communicating with the thrust module 107, the rotary coupling unit 109, and performing transmission and reception of data from the surface drilling and processing unit 105.

From the foregoing it will be appreciated that the apparatus for eliminating the net drill bit torque provided by the present invention represents a significant advance in the art. In one embodiment, a drilling apparatus according to the present invention internally balances drilling torques resulting from drilling into a wellbore, thereby increasing the stability and efficiency of autonomous drilling robots. In another embodiment, changes to drilling parameters affecting drilling forces on the concentric drill bits are applied to control drill bit walk for the purpose of steering the drilling operation in a desired direction in the wellbore.

Although specific embodiments of the invention have been described and illustrated, the invention is not to be limited to the specific forms or arrangements of parts so described and illustrated.

We claim:

1. A drilling apparatus for controlling drill bit torque during a well drilling operation comprising:

a thrust module providing axial thrust force;

a rotary coupling connected to the thrust module and a drilling module, wherein the rotary coupling comprises a rotary encoder operable to determine a relative rotation angle between the thrust module and the drilling module;

the drilling module connected to the rotary coupling to receive thrust from the thrust module and to receive signals from the rotary encoder indicative of relative rotation angle between the drilling module and the thrust module, wherein the drilling module comprises a drill bit divided into an outer drill bit and an inner drill bit, the inner and outer drill bits connected to a power unit operable to drive the inner and outer drill bits in opposite directions simultaneously; and a control module connected to the power unit and operable to control a relative rotational velocity of the inner and outer drill bit.

2. The drilling apparatus of claim 1 further comprising:

a linear actuator operable to provide axial movement of the inner drill bit with respect to the outer drill bit in response to the signals received from the rotary encoder.

3. The drilling apparatus of claim 2 wherein the axial movement of the inner drill bit with respect to the outer drill bit produces change in weight-on-bit distribution between the inner drill bit and the outer drill bit to adjust net drilling bit torque.

4. The drilling apparatus of claim 2 wherein the angular rotation position of the drilling module with respect to the thrust module is used to adjust weight-on-bit distribution between the inner drill bit and the outer drill bit.

5. The drilling apparatus of claim 1 wherein the angular rotation position of the drilling module with respect to the thrust module is used to adjust rate of rotation of the inner drill bit and/or the outer drill bit.

6. The drilling apparatus of claim 1 wherein the control module comprises means for:

communicating with a surface drilling and processing apparatus;

processing angular rotation of the drilling module with respect to the thrust module to adjust the torque associated with drill bits.

7. The drilling apparatus of claim 1 wherein the control module comprises means for:

communicating with a surface drilling and processing apparatus;

receiving from the surface drilling and processing apparatus a resultant vector computed from component vectors;

comparing the resultant vector to a desired vector corresponding to a desired drilling direction;

determining at least one adjustment to at least one component vector required to modify the resultant vector to achieve the desired vector; and adjusting drilling parameters corresponding to the force corresponding to the adjusted at least one component vector.

8. The drilling apparatus of claim; 7 wherein the control module transmits direction parameters of the outer drill bit and inner drill bit to the surface drilling and processing apparatus.

9. The drilling apparatus of claim 7 wherein the control module receives corrections to the drilling parameters from the surface drilling and processing apparatus.

10. The drilling apparatus of claim 9 wherein the control module processing the corrections to the drilling parameters received from the surface drilling and processing apparatus further comprises means for:

adjusting the force associated with rotation of the inner drill bit and the outer drill bit; and in response controlling a drill bit walk.

11. A method of operating a drilling apparatus having a thrust module and a drilling module with a plurality of drill bits, comprising:

rotating a first drill bit in a first direction at a first rotational velocity;

rotating a second drill bit in a second direction opposite to the first direction at a second rotational velocity;

providing thrust on the drilling module from the thrust module;

determining a relative rotation between the drilling module and the thrust module; and adjusting at least one of the first rotational velocity and second rotational velocity in response to detecting the relative rotation between the drilling module and thrust module.

12. The method of operating a drilling apparatus of claim 11, wherein determining a relative rotation comprises:

obtaining the relative rotation from a rotary encoder.

13. The method of operating a drilling apparatus of claim 11, wherein:

if the relative rotation indicates that the torque on the second drill bit is greater than the torque on the first drill bit, decrease the rotational velocity of the second drill bit.

14. The method of operating a drilling apparatus of claim 11, wherein:

if the relative rotation indicates that the torque on the second drill bit is less than the torque on the first drill bit, increase the rotational velocity of the second drill bit.

15. The method of operating a drilling apparatus of claim 13 or 14, wherein:

if the rotational velocity of the second drill bit is less than a minimal value, enter into an emergency mode in which one drill bit is held stationary and the other drill bit is rotated and axially moved with respect to the stationary drill bit.

16. The method of operating a drilling apparatus of claim 15 wherein the first and second drill bit are alternately held stationary while the other drill bit is axially moved.

17. The method of operating a drilling apparatus of claim 11, wherein:

if the rotational velocity of the second drill bit is less than a minimal value, enter into an emergency mode in which one drill bit is held stationary and the other drill bit is rotated and axially moved with respect to the stationary drill bit.

18. The method of operating a drilling apparatus of claim 11, comprising:

determining relative torque on the first and second drill bit;

determining trajectory of the drilling module;

determining a difference between a desired trajectory and the determined trajectory;

determining the relative torque required to achieve the desired trajectory from the determined trajectory and relative torque;

adjusting the rotational velocity of the first or the second drill bit to achieve the relative torque required to achieve the desired trajectory.

19. The method of operating a drilling apparatus of claim 18, further comprising:

determining force vectors produced by torque on the first and the second drill bit;

determining an actual resultant vector from the force vectors;

determining a desired resultant vector;

comparing the desired resultant vector to the actual resultant vector;

if the desired resultant vector does not match the actual resultant vector, adjust drilling forces to achieve the desired resultant vector.

20. The method of operating a drilling apparatus of claim 19, wherein the adjusting drilling forces comprises an operation selected from adjusting the rotational velocity of the first drill bit, adjusting the rotational velocity of the second drill bit, adjusting the axial relationship between the first and second drill bit.

* * * * *